United States Patent [19]

Trujillo

[11] Patent Number: 4,913,244

[45] Date of Patent: Apr. 3, 1990

[54] LARGE COMPACT CUTTER ROTARY DRILL BIT UTILIZING DIRECTED HYDRAULICS FOR EACH CUTTER

[75] Inventor: William R. Trujillo, West Jordan, Utah

[73] Assignee: Eastman Christensen Company, Salt Lake City, Utah

[21] Appl. No.: 266,323

[22] Filed: Oct. 31, 1988

Related U.S. Application Data

[63] Continuation of Ser. No. 906,169, Sep. 11, 1986, abandoned.

[51] Int. Cl.[4] ..... E21B 10/00

[52] U.S. Cl. ..... 175/65; 175/329; 175/393

[58] Field of Search ..... 175/65, 329, 339, 340, 175/343, 424

[56] References Cited

U.S. PATENT DOCUMENTS

| | | | |
|---|---|---|---|
| 4,098,363 | 7/1978 | Rohde et al. | 175/329 |
| 4,303,136 | 12/1981 | Ball | 175/329 |
| 4,352,400 | 10/1982 | Grappendorf | 175/329 |
| 4,471,845 | 9/1984 | Jürgens | 175/329 |
| 4,505,342 | 3/1985 | Barr et al. | 175/329 |
| 4,545,441 | 10/1985 | Williamson | 175/329 |
| 4,577,706 | 3/1986 | Barr | 175/329 |

FOREIGN PATENT DOCUMENTS

| | | |
|---|---|---|
| 0182770 | 5/1986 | European Pat. Off. . |
| 2085945 | 5/1982 | United Kingdom . |

OTHER PUBLICATIONS

Koskie, E. T., Jr., "Common-Sense Measures Improve PDC Bit Performance", (Sep. 1982) World Oil.

*Primary Examiner*—William P. Neuder
*Attorney, Agent, or Firm*—Joseph A. Walkowski

[57] ABSTRACT

An improved rotating drag bit for cutting plastic, sticky, water reactive and shale formations is devised by providing a plurality of large diamond cutters having a circular cutting face in excess of three quarter inch in diameter. Each large cutter is provided with at least one hydraulic nozzle which in turn provides a directed hydraulic flow at the corresponding cutter face. The directed hydraulic flow is positioned to apply a force to the chip which tends to peel the chip away from the cutter face. In addition, the hydraulic flow is positioned with respect to the chip so as to apply on off-center torque to the chip which is used to peel the chip away from the cutter face and toward the gage of the bit. In particular, the nozzle defines a jet which is characterized by a direction and velocity of hydraulic fluid determined by the jet characteristics. The core is generally symmetric about its longitudinal axis and has a length along the longitudinal axis and width perpendicular thereto. The point of the jet most distant from the nozzle defines an impact point of the jet against the chip and cutter face. The longitudinal axis of the jet is chosen so that at least a portion of the jet lies between the cutter face and the chip as it is being peeled from the cutter. Hydraulic removal of the chips is further facilitated by a plurality of junk slots having a contoured compound surface. The junk slot is characterized by having at least two distinct cross-sectional profiles, namely an asymmetric profile at its lower portion nearest the bit face and a symmetric profile along its upper portion. The asymmetric and symmetric profiles are connected by a surface providing a smooth hydrodynamic transition.

33 Claims, 3 Drawing Sheets

LARGE COMPACT CUTTER ROTARY DRILL BIT UTILIZING DIRECTED HYDRAULICS FOR EACH CUTTER

This application is a continuation, of application Ser. No. 906,169, filed 9/11/86 now abandoned.

BACKGROUND OF THE INVENTION

1. Field of the Invention

The invention is related to the field of earth boring tools, and in particular rotating drag bits having large polycrystalline diamond compact cutters or other large composite-type cutters of similar materials for use in drilling in shale, clay and other sticky formations, sometimes referred to as "gumbo".

2. Description of the Prior Art

One of the most significant problems encountered when drilling in shale, clay or other water reactive, sticky formations is the tendency of the bits to ball or become clogged during drilling. The typical approach of the prior art in dealing with such soft and sticky formations has been to provide large cutters with strong hydraulics in the proximity of the cutters and to attempt to remove the cuttings from the cutter faces with a high volume, high velocity hydraulic jet flow. See, for example, Feenstra, "Rotary Bit with Ridges", U.S. Pat. No. 4,116,289 (1978).

Typically, such prior art cutters include impregnated diamond blade cutters, sintered diamond compact cutters, such as manufactured by General Electric Co. under the trademark "Compax", are limited in size, typically being equal to or less than 13.3 mm in diameter. Therefore, in order to obtain the cutter sizes required or desirable for sticky drilling, impregnated diamond elements are used such as shown by Short, "Blade-Type Drill Bit", U.S. Pat. No. 3,153,458 (1964), and Feenstra, supra.

Recently, however, large size diamond compact discs have become commercially available measuring between three quarters of an inch and two inches in diameter. However, these large diamond discs have been employed essentially as their smaller predecessors, such as diamond stud cutters sold under the trademark "Stratapax" by General Electric Company. As a result, the large diamond discs have been subject to the same drawbacks and detriments with respect to cutting sticky or plastic or water reactive formations as prior art blade bits.

Therefore, what is needed is some means whereby the large diamond cutter may be employed to cut into clay, shale or plastic formations in such a manner that bit balling and other drawbacks of the prior art are substantially avoided.

BRIEF SUMMARY OF THE INVENTION

The invention is an improvement in a rotating bit for cutting a plastic formation comprising a plurality of polycrystalline diamond cutters. At least one cutter has a large diamond cutting surface which is at least as large as a three quarter inch diameter circle. The nozzle defines a directed hydraulic flow to the large cutter. The flow directed by the nozzle is arranged and configured to apply a force to the chip which is cut by the large cutter. The force tends to peel the chip from the face of the cutter. As a result, the plastic formation is cut with little tendency of the bit to ball.

The bit comprises a plurality of the large cutters and a corresponding plurality of the nozzles. At least one nozzle is provided for each large cutter and provides the directed hydraulic flow to each cutter face.

The nozzle directs the hydraulic flow to the cutter face of the large cutter into the proximity of the center of gravity of the chip.

The nozzle directs the hydraulic flow into the proximity of the center of gravity of the chip and radially inward of the center of gravity of the chip. A torque is thus applied to the chip tending to peel the chip off the cutting face of the large cutter toward the gage of the bit.

The directed flow of the nozzle is characterized by a jet. One feature of the jet is an inner core with a length of four to seven times the outer diameter of the orifice of the nozzle. In the core, the center line velocity remains virtually equal to the exit velocity. Another feature of the jet is the width of the jet and pressure cone associated with it which is approximately two times the outer diameter of the nozzle when the core is at full length. See generally, "Preliminary Analysis of a Free Jet From a Circular Nozzle," M. B. Friedman, DTC Hydraulics Consultant, Technical Note No. 1, Sept. 21, 1984.

The jet is defined by flow of hydraulic fluid from the nozzle in a direction and velocity primarily determined by the orientation of the nozzle. The core is substantially symmetric about a longitudinal axis. The jet has a width perpendicular to the longitudinal axis and a length along the longitudinal axis. That point on the longitudinal axis of the jet most distant from the nozzle is defined as an impact point of the jet. The impact point of the jet is directed toward a location proximate to attachment of the chip to the rock formation.

If the maximum energy of the core is to be realized the impact point of the jet is at least within 0.4 to 0.7 inch of the center of gravity of the corresponding chip for the illustrated design. This should not be construed as a limiting factor however. The essence of this approach is to aggressively or pointedly attack the chip with the drilling fluid. It is entirely within the scope and spirit of the invention that jet characteristics and relationship to the cutter and chip may be entirely outside the optimal ranges set forth above. In fact, the cutters may be nearly as effective with a nonoptimal jet as with an optimal jet, although it is expected that optimal jets and jet relationships to the cutters will produce better results.

The longitudinal axis of the jet can be disposed at least at one point between the chip and cutting face of the corresponding cutter if so desired.

The invention is also a method for removing chips cut from a formation by a bit having a center and gage comprising the steps of cutting a chip by a cutter, directing a defined hydraulic flow toward the chip, and applying a force from the hydraulic flow to the chip in a direction away from the cutter which is cutting the chip to thereby peel the chip off the cutter. As a result, the formation is drilled without substantial risk of balling the bit.

In the step of applying the force, the force is applied at a point into the proximity of the center of gravity of the chip to thereby generate a torque on the chip.

In the step of applying the torque to the chip, the torque is applied to the chip and peels the chip from the cutter toward the gage.

In the step of cutting the formation, the chip is cut by a cutter having a cutting surface with an area at least as great as a circle 0.75 inch in diameter.

The invention is also an improvement in a rotating bit having a bit face and gage comprising at least one junk slot defined in the gage of the bit. The junk slot has a compound profile along its longitudinal length opposite the gage. The compound profile includes at least two distinct cross-sectional configurations perpendicular to the longitudinal axis of the junk slot, and a smooth hydrodynamic transition being provided between the at least two distinct profiles. As a result hydraulic flow within the junk slot is substantially improved.

The two profiles of the junk slot comprise a symmetric profile and asymmetric profile.

The symmetric profile is longitudinally defined within the junk slot farther from the bit face than the asymmetric profile.

At least one portion of the asymmetric profile is identical to the symmetric profile.

The invention is more graphically depicted in the following drawings where like elements are referenced by like elements.

The invention and its various embodiments may be better understood by now turning to the following detailed description.

DETAILED DESCRIPTION OF THE PREFERRED EMBODIMENTS

An improved rotating drag bit for cutting plastic, sticky, water reactive clays and shales is devised by providing a plurality of large diamond cutters having a circular cutting face equal to or in excess of 0.75 inch in diameter. In the preferred embodiment, the cutters are approximately one inch in diameter or larger. Each large cutter is provided with at least one hydraulic nozzle which in turn provides a directed hydraulic flow at the corresponding cutter face. The directed hydraulic flow is positioned to apply a force to the chip which tends to hydraulically separate the chip away from the cutter face. In addition, the hydraulic flow is positioned with respect to the chip so as to apply an off-center torque to the chip which is used to peel the chip away from the cutter face and toward the gage of the bit. In particular, the nozzle defines a jet which is characterized by a direction and velocity of hydraulic fluid determined by the jet characteristics. The core is generally symmetric about its longitudinal axis and has a length along the longitudinal axis and width perpendicular thereto. The point of the jet most distant from the nozzle defines an impact point of the jet against the formation, the chip and/or cutter face. The longitudinal axis of the jet is chosen so that at least a portion of the jet can lie between the cutter face and the chip as it is being peeled from the cutter. Hydraulic removal of the chips is further facilitated by a plurality of junk slots having a contoured compound surface.

A rotating drill bit is provided with a large diamond compact slug, typically of one to two inches in diameter or greater, each of which is provided with at least one hydraulic nozzle. Hydraulic fluid is directed under pressure from the nozzle to a predetermined point with respect to the corresponding large diamond cutter and its corresponding chip. In particular, the fluid flow from the nozzle is focussed or has a point of maximum impulsive impact at a predetermined point positioned with respect to the rock chip cut by the corresponding cutter so that a force is applied to the chip to separate it from the diamond cutter by hydraulic differential unloading and/or applying an unbalanced torque to the chip. In essence, the focal point of the stream of hydraulic fluid from the nozzle is directed at a point at or near the base and to the inside of attachment or adhesion of the rock chip to the face of the diamond cutter. The manner in which this can be implemented can best be understood by first turning to the interior top plan view of a mold shown in FIG. 1 by which a bit incorporating the invention is molded according to conventional matrix infiltration processes.

Figure 1:
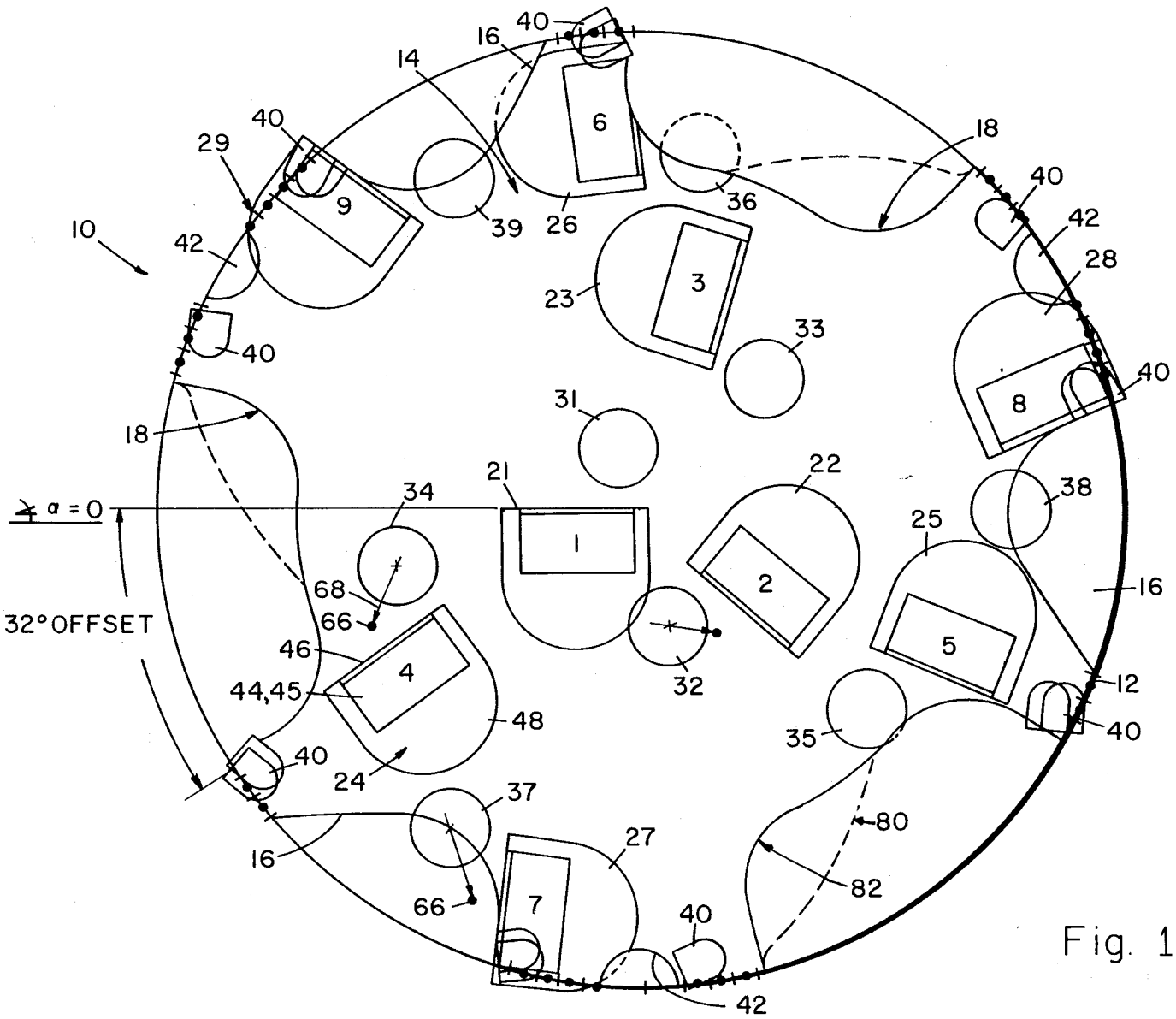
FIG. 1 is a top plan view of an inside of a mold from which a matrix bit incorporating the invention is fabricated.

What is shown in FIG. 1 is a plan view of the settings of the large diamond compact cutters on the face of a bit as seen looking into a mold in which such a diamond bit would be made by matrix infiltration. Thus the bit, generally denoted by reference numeral 10, is characterized by an exterior cylindrical surface or gage 12 terminated on its lowermost portion by a bit face, generally denoted by reference numeral 14. Defined within gage 12 is a plurality of junk slots 16 and 18. Junk slots 16 are distinguishable from junk slots 18 in that junk slots 16 have a uniform contour as opposed to a contoured or compound surface within junk slots 18 as will be described below.

In the embodiment illustrated in FIG. 1, a 12¼ inch diameter bit is illustrated in which nine large cutters 21–29 will be formed. For the sake of clarity of illustration each cutter is shown in midline cross-sectional view with the diamond cutter in place. In actuality the diamond slugs may be fixed or brazed into the bit in a later step, and would not be seen in place in the mold as depicted in FIG. 1. See generally, Rhode et. al., "Diamond Drilling Bit for Soft and Medium Hard Formation," U.S. Pat. No. 4,098,363 (1978) for background information concerning the casting of the bit body, cutter shapes and materials, and various methods of attachment of the cutters. However for ease of conceptualization, FIG. 1 illustrates the diamond cutters in place as would be seen looking downward through the diamond bit toward the rock formation. In reality in a top plan view of a mold, only the pockets into which the diamond slugs were later brazed would be seen.

Corresponding to each cutter is a nozzle 31–39 which provides a directed flow as also described more completely below. Nozzle 31 thus provides directed flow for cutter 21, nozzle 32 for cutter 22 and so forth through nozzle 39 and cutter 29. In addition to cutters 21–29, a plurality of gage cutters 40 are defined within the shoulder and gage of bit 10 as better depicted and described below in connection with FIG. 2, but which are also illustrated in FIG. 1 in a sometimes overlying relationship. The depiction in FIG. 1 of gage cutters 40 appears to be overlying since the cutters, which may be vertically separated, are superimposed in the diagrammatic view of FIG. 1.

In addition to junk slots 16 and 18, a plurality of collectors 42 are similarly provided within gage 12. These are provided to enhance the cleaning and cooling of gage cutters 40. Gage defining cutters 40 are comprised of conventionally fabricated Stratapax or Compax cutters and can, by virtue of their relative scale to cutters 21–29, provide a relative feel for the sizes of cutters 21–29. In the prior art, gage defining cutters 40 usually represented the largest integral diamond compacts then available for cutting in shale or plastic formations. In the present application, what was previously the primary cutters in prior art polycrystalline diamond compact drill bits, now serve only a secondary cutting function as gage defining cutters.

Figure 5:
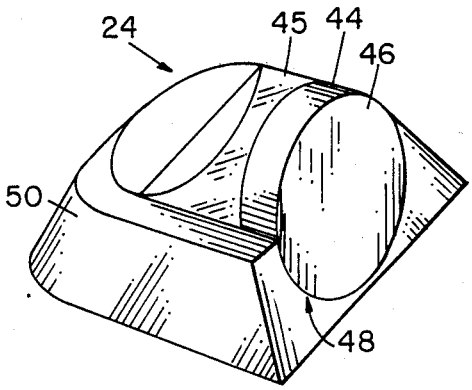
FIG. 5 is a perspective view of a single cutter as shown in FIGS. 1–4.

Before considering further details of the relationship between the directed hydraulic flow from nozzles 31–39 and their corresponding cutters 21–29, turn first to the perspective depiction of FIG. 5 wherein a single one of the cutters is illustrated. Cutter 24 is chosen for the purposes of example. Cutter 24 comprises a tungsten carbide slug 44 1.50 inches in diameter and approximately 0.3 inch thick. Mounted in the face of the slug 44 is an integral diamond compact table 46. Diamond table 46 and slug 44 are manufactured and bonded together within a diamond press and are sold as such a unit by De Beers of South Africa. See generally, Peschel, "Cutter Head, Drill Bit and Similar Drilling Tools," U.S. Pat. No. 4,200,159 (1980) for background relating to brazing of slug cutters into an infiltration bit, and in particular refer to FIG. 7 and the associated text of Peschel. Diamond table 46 has a diameter substantially equal to that of slug 44. Substrate or carrier 45 is brazed into pocket 48. Slug 44 is then brazed into pocket 48 in front of substrate 45. Pocket 48 is formed in an island 50 which is a grooved projection of the basic body 14. At the present time, De Beers supplies slug 44 and table 46 as an integral unit. This unit has a longitudinal thickness of approximately 8 mm (0.315 inch) and lacks sufficient thickness for adequate shock protection and load resistance. Hence, carrier 45, which is made of tungsten carbide and is approximately 14 mm thick is bonded or brazed thereto. Generally, cutters 21–29 of the embodiment of FIG. 1 have a predetermined rake angle of diamond table 46 as determined by a milled-in rake angle of island 50. In the illustration of FIG. 1, however, each cutter 21–29 has been shown only in a midline section for the sake of clarity. Therefore it must be kept in mind that portions of the face of diamond table 46 actually extend both in front of and behind the midsection line shown in FIG. 1 for each cutter 21–29 by an amount depending on the rake angle of each cutter.

The preferred embodiment is a diamond compact disc brazed into a pocket with a support or carrier. The cutter can have different shapes, e.g. triangular, hexagonal, square, or octagonal. The cutter can be composed of thermally stable diamond or some other material such as silicon carbide, tungsten carbide, or boron carbide. During manufacture of the bit, the cutter can be furnaced with the bit body in order to attach it to the bit. What is disclosed here is a large cutter with at least one directed nozzle providing cleaning and cooling of the cutter.

Consider now the relationship between the direction of hydraulic flow from each nozzle 31–39 and its corresponding cutter 21–29. In particular, consider cutter 24 and nozzle 34 depicted in FIG. 1. Listed below in Table 1 is a summary of cutter locations.

TABLE 1

| CUTTER LOCATION | | | | |
|---|---|---|---|---|
| No. | Rad. | | SR | BR |
| 21 | 0.78 | 0 | 3 | 15 |
| 22 | 1.89 | 135 | 5 | 13 |
| 23 | 2.90 | 245 | 5 | 10 |
| 24 | 3.75 | 28 | 5 | 10 |
| 25 | 4.39 | 150 | 5 | 11 |
| 26 | 4.98 | 270 | 5 | 13 |
| 27 | 5.44 | 70 | 5 | 15 |
| 28 | 5.44 | 190 | 5 | 15 |
| 29 | 5.44 | 310 | 5 | 15 |

The locations listed above are the locations which are machined in the graphite mold from which the bit is made. After furnacing, these locations are reduced a small amount due to shrinkage upon cooling. Cutter 24 has the center of its midline section of diamond table 46 at a radial distance of 3.75 inch from the center of bit 10 prior to shrinkage. Taking the center of cutter 21 as an arbitrary reference point of 0 degrees, the azimuthal position of the center of cutter 24 appears at an angular position of 28 degrees. Face 46 of cutter 24 is not parallel to a radius, but has a side rake of 5 degrees. In other words, as viewed in FIG. 1, cutter 24 has been rotated so that face 46 is not aligned with the radius but is rotated or canted counterclockwise by 5 degrees in a plane parallel to the bit profile. Similarly, the back rake of cutter 24 is 10 degrees, although not shown in the figures. In other words, if the diamond face 46 of cutter 24 were shown in three dimensions, a rotation perpendicular to the bit profile as shown in FIG. 1 of 10 degrees would be observed.

Turn now to the nozzle placement, in particular for nozzle 34, as summarized in Table 2 below.

TABLE 2

| NOZZLE LOCATION | | | | |
|---|---|---|---|---|
| No. | Rad. | | | Offset |
| 31 | 0.77 | 248 | 20 | 172 |
| 32 | 1.60 | 103 | 20 | 69 |
| 33 | 2.30 | 225 | 35 | 67 |
| 34 | 3.20 | 14 | 35 | 61 |
| 35 | 3.89 | 138 | 35 | 57 |
| 36 | 4.55 | 259 | 35 | 50 |
| 37 | 4.79 | 59 | 40 | 48 |
| 38 | 4.79 | 179 | 40 | 48 |
| 39 | 4.79 | 299 | 40 | 48 |

Nozzle 34 has its center at a radial displacement of 3.20 inch from the center of bit 10. Arrow 68 diagrammatically represents the direction of hydraulic flow of nozzle 34. The azimuthal position of the center of nozzle 34 is at an azimuthal angle of 14 degrees, as denoted by angle alpha in Table 2, again from a reference line of the face of cutter 1. The angular offset of the direction of hydraulic flow denoted by arrow 68 is then 61 degrees offset from the reference direction. Furthermore, nozzle 34 is tilted from the vertical axis, the longitudinal axis of bit 10, by 35 degrees in a direction which is perpendicular to the plane of the drawing of FIG. 1. These two angular orientations combined with the 61 degree offset therefore specify that the point, denoted by reference numeral 66, at which arrow 68 impacts the formation. Point 66 is at the base of and in front of diamond surface 46 of cutter 24. The physical significance of arrow 68 and its corresponding point 66 is understood as follows.

Figure 3:
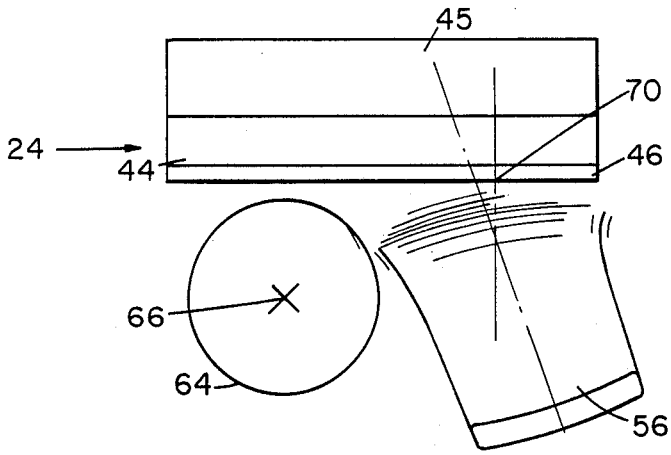
FIG. 3 is a diagrammatic depiction of the direction of hydraulic flow with respect to the cutter face and chip of a single cutter as depicted in FIGS. 1 and 2.
Figure 4:
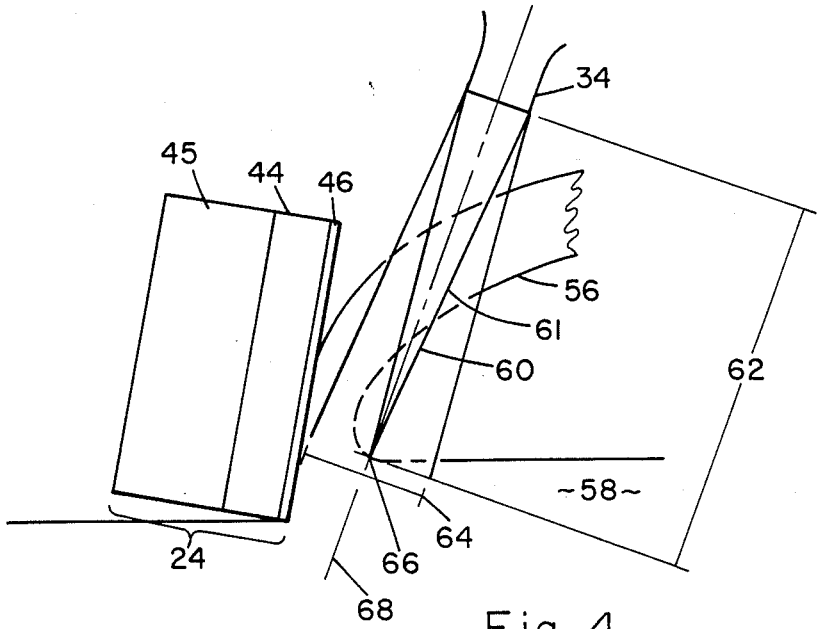
FIG. 4 is a diagrammatic side sectional view of the depiction of FIG. 3.

The directed hydraulic nozzle flow with respect to diamond face 46 may better be understood by turning now to the diagrammatic depictions of FIG. 3 and 4. FIG. 3 is a plan diagrammatic view of a cutter, such as cutter 24. Substrate 44 behind and bonded to diamond table 46 is shown in diagrammatic top plan view and immediately behind a chip 56 being cut from the rock formation. As better seen in side diagrammatic view in FIG. 4, chip 56 is sheared from the rock formation, generally denoted by reference numeral 58. Since formation 58 is sticky or plastic, chip 56 remains substantially intact and will generally move upward across diamond face 46 of cutter 24 and normally tends to adhere to face 46. Nozzle 34, corresponding to cutter 24, provides a directed flow of hydraulic fluid to form a jet 60 shown in FIG. 4. Jet 60 is characterized by a region of hydraulic flow which has a direction and velocity principally determined by nozzle 34. Generally, core 61 has a length denoted by dimension 62 in FIG. 4 of four to seven times the outer diameter of the orifice of nozzle 34 and a pressure cone associated with the jet with a width, denoted by reference numeral 64 approximately two times the outer diameter of the orifice of nozzle 34. Like the flame tip of a torch, core 61 has a tip 66 which defines an impact point of jet 60. Furthermore, core 61 is generally symmetric about a longitudinal axis 68 from the center of nozzle 34 to impact point 66. Impact point 66 can be characterized as the point of primary or maximized force furtherest away from the orifice of the corresponding nozzle. As best depicted in FIG. 4, axis 68 of jet 60 is directed to the base of chip 56 so that the impact point will lie near the base of chip 56, typically within the lower half of diamond face 46 and offset from the center of chip 56 or face 46. Ideally, impact point 66 will lie at a distance of 0.4 to 0.7 inches away from the center of gravity 70 of chip 56 as depicted in FIG. 4. This imparts or tends to impart a force which pries off chip 56 from diamond face 46 as depicted in FIGS. 3 and 4. Otherwise, chip 56 would generally be tightly adhered to diamond face 46.

In addition, a torque also tends to be applied to chip 56 by virtue of the moment arm between impact point 66 and center of gravity 70. Therefore, chip 56 also tends to be twisted off or peeled off face 46. In the preferred embodiment, torque applied to each chip 56 on each cutter and chip is directed to peel chips 56 toward gage 12 of bit 10.

Figure 2:
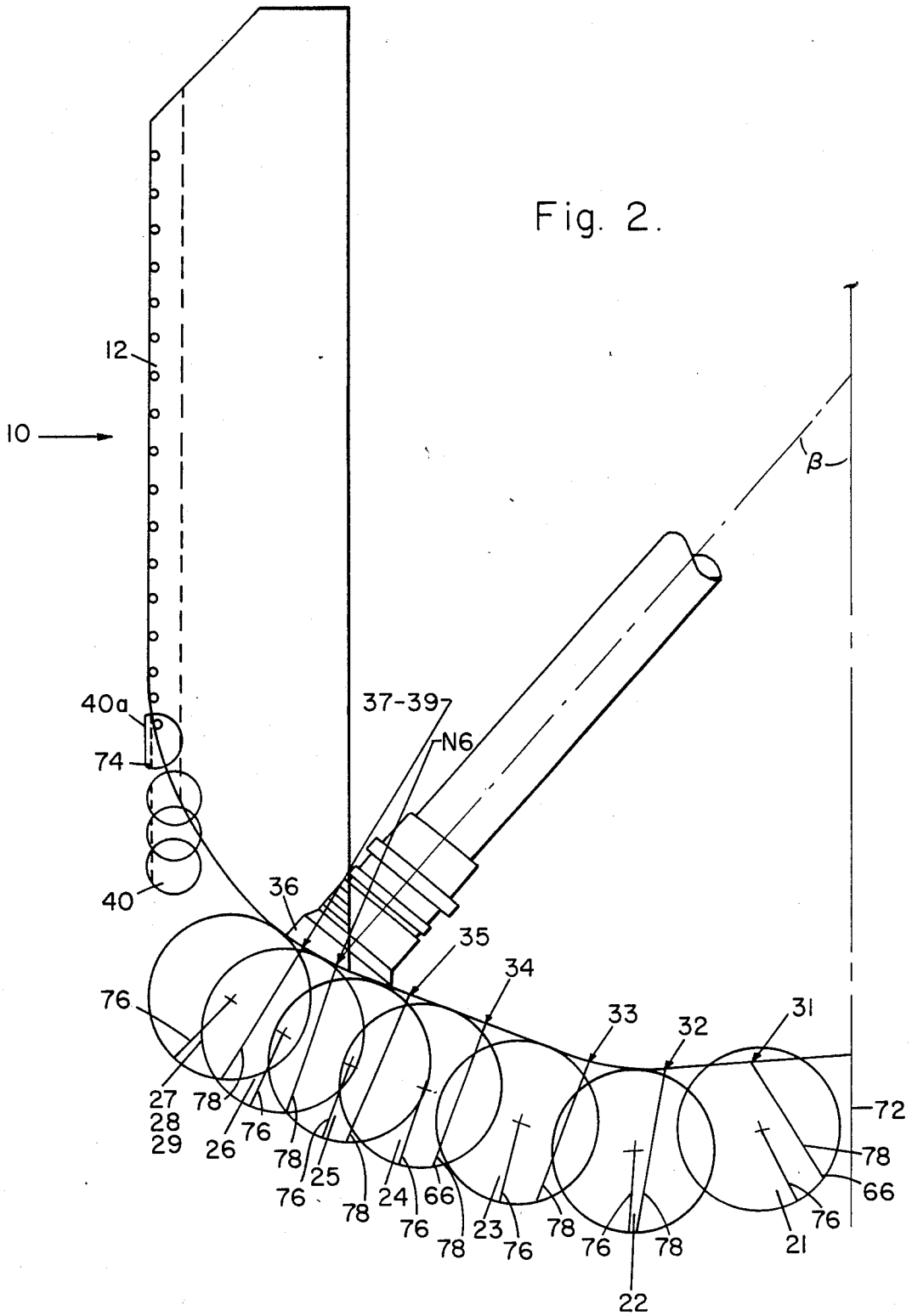
FIG. 2 is a diagrammatic cross-sectional view of a bit manufactured from the mold plan shown in FIG. 1.

This feature is better illustrated in FIG. 2. Turn to FIG. 2 which is a diagrammatic cross-sectional depiction of half of the profile of bit 10 showing each of the circular diamond faces 46 of cutters 21–29 superimposed on the profile as would be obtained after a full revolution of bit 10. Firstly, it is immediately apparent that cutters 21–29 provide overlapping coverage from center line 72 of bit 10 to gage 12. In fact, the outermost cutters 27–29 provide triple redundancy at gage 12 where cutting rates and impact shocks are generally highest. Further, the density of cutter overlap can be seen to increase toward gage 12. In other words, a greater fraction of the cutting face of cutter 26 overlaps with the cutting faces of cutters 27–29 than does the degree of overlap between the cutting faces of cutters 21 and 22.

FIG. 2 also illustrates the vertical dispersion of gage protection cutters 40. Each of the full cutters 40 is provided with triple redundancy on bit 10 with the exception of fractional cutters **40*a*, which have been cut by laser cutting or EDM to comprise a portion of the full disc with a flat edge 74 directed outwardly to define gage 12. A sixfold redundance of cutters 40*a* is provided on bit 10. Cutters 40 and 40*a*** do not actively cut the formation. They insure the hole size is maintained. They do not cut the bottomhole, and do not require direct cleaning.

Consider now the relationship between the directed flow of nozzles 31–34 in connection with the cutting faces of cutters 21–29 as depicted in FIG. 2. Again consider for example cutter 24. Cutter 24, as is each cutter, is associated with an imaginary line 76 along which the center of gravity of chip 56 will be positioned. The exact point of the center of gravity of chip 56 along line 76 will depend upon the depth of cut as well as upon the amount of cutter remaining after wear. Thus line 76 represents the locus of the center of gravity of chip 56 over time. Similarly, the projection of axis 68 of hydraulic jet 60 onto the cutting face of cutter 24 defines an imaginary line 78. As shown in FIG. 2, line 78, which is indicative of the center of effort of jet 60, lies inboard of line 76 representing the position on the center of gravity of chip 56. Thus, a peeling torque is provided for cutter 24 regardless of the amount of wear or the degree of embedment of cutter 24 into formation 58.

It may be verified with each of the cutters that line 78 representative of the center force of jet 60 lies inboard of its corresponding line 76.

Returning to FIG. 1, it can now be illustrated that the point of impact 66 does not in each case lie at the same distance away from cutter face 46 of its corresponding cutter. This is largely an artifact of manufacture arising from the limited space within bit 10 in which nozzles 31–39 may be angled. Such displacements can in any case be manipulated as a design feature of the present invention.

In the illustrated embodiment nozzles 31–39 are replaceable from the exterior of bit face 14. Therefore, sufficient space must be provided between each nozzle 31–39 and it corresponding cutter 21–29 to allow insertion and removal of the nozzle and to allow the use of appropriate tools. In the case where the nozzles are permanently fixed or are removable from the interior of bit 10, it may be possible that the variation of the distance between impact point 66 and corresponding cutter faces 46 as shown in FIG. 1 would not occur. The fluid can actually impact cutter face 46 between the cutter and chip 56 if so desired.

The junk slot is characterized by having at least two distinct cross-sectional profiles, namely a symmetric profile at its upper portion farthest from the bit face and an asymmetric profile along its lower portion. The asymmetric and symmetric profiles are connected by a surface providing a smooth hydrodynamic transition.

Consider specifically the contoured junk slots 18 as depicted in FIG. 1. Junk slot 18 is a longitudinal cavity defined within gage 12 to facilitate removal of cut material. In the lower portion of junk slot 18, nearest bit face 14, junk slot 18 is characterized by a first asymmetric profile shown in dotted outline in FIG. 1 as portion 80. The upper portion of junk slot 18, furthest away from the face 14, has a distinct second profile 82 as depicted in solid outline in FIG. 1. Thus, the lower section of junk slot 18 has a nonuniform asymmetric profile 80 while the upper section has a substantially uniform symmetric profile 82. The transition between profiles 80 and 82 within the middle region of junk slot 18 is smoothed so that cross sections (not shown) would reflect a smooth hydrodynamic transition between the dramatically different profiles 80 and 82.

In the illustrated embodiment the first profile 80 has been shown with a wedge shaped leading portion, which transitions to a full depth, following portion which is equivalent to second profile 82. It is entirely within the scope of the invention that profile 80 may be reversed, namely having a full depth leading profile transitioning to a wedged-shaped following portion. Furthermore, any junk slot profile known in the art, in addition to profiles 80 and 82 illustrated in FIG. 1, may be used or variously combined with each other as may be desired. Similarly, the longitudinal relationship of the portions may be reversed if desired. For example, asymmetric profile 80 may characterize the upper section of junk slot 18, while full portion 82 would characterize the lower section nearest bit face 14.

It has been observed that reverse flow, turbulent or unstable flows and eddies which have been observed in conventional junk slots, which have a single profile throughout their longitudinal length, can be avoided or at least substantially diminished when the compound surface represented by profiles 80 and 82 of junk slot 18 are used according to the invention.

Many alterations and modifications may be made by those having skill in the art without departing from the spirit and scope of the invention. Therefore the illustrated embodiment must be understood merely as an example set forth for the purposes of illustration and not by way of limitation of the invention as defined in the following claims.

I claim:

1. An improvement in a rotating bit for cutting chips from a plastic formation comprising:

a plurality of cutters, wherein at least one cutter has a large diamond cutting surface at least as large as a three quarter inch diameter circle, each cutter adapted to cut a chip from said formation; and at least one nozzle means for directing a defined hydraulic flow only to said large cutter, said flow directed by said nozzle means applying a torque to said chip cut by said large cutter, said torque tending to twist said chip from said face of said cutter, said nozzle means associated with said cutter having a center placed in nonsymmetrical relationship to said lateral dimension of said associated cutter, wherein said nozzle directs said hydraulic flow to said cutter face of said large cutter at a position in the proximity of the center of gravity of said chip, whereby said chips of said plastic formation are cut by the minimum tendency of said bit to ball.

2. The improvement of claim 1 wherein said nozzle directs said hydraulic flow into the proximity of the center of gravity of said chip and radially inward of said center of gravity of said chip with respect to the center of said bit, a torque thus being applied to said chip tending to peel said chip off said cutting face of said large cutter toward said gage of said bit.

3. The improvement of claim 1 wherein said directed flow of said nozzle is characterized by a jet, said jet defined by flow of hydraulic fluid from said nozzle in a direction and velocity primarily determined by said nozzle, said jet having a pressure core being substantially symmetric about a longitudinal axis, said jet having a width perpendicular to said longitudinal axis and a length along said longitudinal axis, that point on said longitudinal axis of said jet most distant from said nozzle being defined as an impact point of said jet, said impact point of said jet being directed toward a location proximate to attachment of said chip to said rock formation.

4. The improvement of claim 3 wherein said impact point of said jet is within 0.4 to 0.7 inch of the center of gravity of said corresponding chip.

5. The improvement of claim 3 wherein said width of said pressure cone is approximately two times the outer diameter of said orifice of said nozzle.

6. The improvement of claim 3 wherein said longitudinal axis of said jet is disposed at least at one point between said chip and cutting face of said corresponding cutter.

7. An improvement in a rotating bit for cutting a chip from a plastic formation comprising:

a plurality of polycrystalline diamond cutters, wherein at least one cutter has a large diamond cutting surface at least as large as a three quarter inch diameter circle, each cutter cutting a chip from said formation; and at least one nozzle means for defining a directed hydraulic flow only to said large cutter, said flow directed by said nozzle means applying a torque to said chip cut by said large cutter, said torque tending to twist said chip from said face of said large cutter, wherein said nozzle means directs said hydraulic flow to said cutter face of said large cutter at a position into the proximity of the center of gravity of said chip as determined by chip shape, said chip shape in turned determined by shape of said large cutter, said nozzle means being positioned at a radially difference distance from the center of said bit than the middle of the cutting face of said large cutter, wherein said bit has a center and a gage, and wherein said nozzle means directs said hydraulic flow into the proximity of the center of gravity of said chip and radially inward of said center of gravity of said chip with respect to the center of said bit, a torque thus being applied to said chip tending to peel said chip off said cutting face of said large cutter toward said gage of said bit, whereby said chip of said plastic formation is cut by the minimum tendency of said bit to ball.

8. An improvement in a rotating bit for cutting a plastic rock formation comprising:

a plurality of polycrystalline diamone cutters, wherein at least one cutter has a large diamond cutting surface at least as large as a three quarter inch diameter circle, each cutter cutting a chip from said formation; and at least one nozzle means for defining a directed hydraulic flow only to said large cutter, said flow directed by said nozzle means for applying a torque to said chip cut by said large cutter, said torque tending to twist said chip from said face of said cutter, wherein said directed flow of said nozzle means is characterized by a jet, said jet defined by flow of hydraulic fluid from said nozzle means in a direction and velocity primarily determined by said nozzle means, said jet having a core being substantially symmetric about a longitudinal axis, said jet having a pressure cone having a width perpendicular to said longitudinal axis and a length along said longitudinal axis, that point on said longitudinal axis of said jet most distant from said nozzle means being defined as an impact point of said jet, said impact point of said jet being directed at a point between said chip and said cutting surface of said cutter to wedge said chip away from said cutting face of said cutter, said nozzle means associated with said cutter being oriented with respect thereto so as to direct said hydraulic jet to impinge proximate the location at which said cutting face extends farthest from said bit and nonsymmetrically with respect to said lateral extent of said cutting face, whereby said chip of said plastic formation is cut by the minimum tendency of said bit to ball.

9. A method for removing chips cut from a formation by a bit having a center and gage comprising the steps of:

cutting a chip by a cutter, said chip having a center of gravity as determined by the shape of said chip, the shape of said chip in turn being determined by said cutter which cuts said chip from said formation;

directing a defined hydraulic flow including a pressure core toward said chip to apply a torque to said chip by said pressure core, to thereby twist said chip off said cutter, said hydraulic flow being directed by a nozzle means associated with said cutter cutting said chip said nozzle means for defining a directed hydraulic flow substantially only to said cutter, said nozzle means having a center placed in nonsymmetrical relationship to said lateral dimension of said cutter, whereby said formation is drilled without substantial risk of balling said bit.

10. The method of claim 9 where in said step of applying said torque, said torque is applied at a point into the proximity of the center of gravity of said chip as determined from the shape of said chip as cut by said cutter to thereby generate a maximal torque on said chip.

11. The method of claim 9 where in said step of applying said torque to said chip, said torque is applied to said chip and peels said chip from said cutter toward said gage.

12. The method of claim 9 where in said step of cutting said formation, said chip is cut by a cutter having a cutting surface with an area at least as great as a circle approximately three quarters of an inch in diameter.

13. A rotating bit for cutting a plastic formation comprising:

a bit body;

at least one cutter defining a lateral dimension and mounted on said bit body; and a nozzle associated with said cutter and adapted to define a directed hydraulic flow substantially only to said cutter, said nozzle having a center placed in nonsymmetrical relationship to said lateral dimension of said cutter, wherein said nozzle center is placed radially inward of the midpoint of said lateral dimension of said cutter.

14. The bit of claim 13, wherein said at least one cutter comprises a plurality of cutters.

15. A drill bit for cutting a plastic formation, comprising:

a substantially round bit body;

a plurality of cutters mounted on said bit body, each of said cutters defining a substantially radially-extending cutting face; and a fluid-directed nozzle associated with each of said plurality of cutters, each of said nozzles being positioned at a radially different distance from the center of said bit than the middle of the cutting face of said cutter with which said nozzle is associated, wherein each of said nozzles is positioned radially inward of the middle of the cutting face of its associated cutter.

16. A cutter and nozzle arrangement for use in a rotary bit for earth boring, comprising:

a cutter defining a laterally-extending cutting face and mounted on the face of a bit defining a gage portion; and a fluid-directing nozzle associated with said cutter and oriented with respect thereto so as to direct an hydraulic jet to impinge proximate the location at which said cutting face extends farthest from said bit and nonsymmetrically with respect to said lateral extent of said cutting face.

17. The cutter and nozzle arrangement of claim 16, wherein said nozzle is oriented with respect to said cutter so as to direct said hydraulic jet to a location between the point on said cutting face farthest from said bit gage and the midpoint of the lateral extent of said cutting face.

18. An improvement in a rotating drag bit for drilling in a plastic subterranean formation, comprising:

a plurality of substantially planar cutters comprised of a superhard material, at least one of said cutters having a cutting surface defining a lateral dimension;

at least one nozzle means associated with said at least one cutter and having a center placed in nonsymmetrical relationship to said lateral dimension thereof, said nozzle means being oriented to define a directed hydraulic flow toward said at least one cutter to impact in proximity to the point at which said at least one cutter engages said formation in cutting a chip therefrom.

19. The improvement of claim 18, wherein said nozzle is oriented so that said directed hydraulic flow impacts in proximity to the center of gravity of said chip.

20. The improvement of claim 19, wherein said nozzle is oriented so that said directed hydraulic flow impacts radially inwardly, as measured from the center of the bit, of the center of gravity of said chips.

21. The improvement of claim 18, wherein said nozzle is oriented so that said directed hydraulic flow impacts substantially between said cutting surface and said chip.

22. The improvement of claim 18, wherein said nozzle is oriented so that said hydraulic flow impacts between the point on said cutting surface farthest from said bit gage and the midpoint of said lateral dimension of said cutting surface.

23. A system for drilling a plastic subterranean earth formation, comprising:

a drill bit disposed at an end of a tubular drill string providing a supply of pressurized fluid thereto;

at least one cutter mounted on said bit and defining a cutting surface adapted to cut a chip from said formation upon engagement therewith and having a lateral dimension;

a jet of fluid emanating from said bit and projected to impact on a region on said chip proximate the center of gravity thereof at a point in proximity to that at which said cutting surface engages said formation.

24. The system of claim 23, wherein said jet is projected toward said region to impact on said chip radially inwardly, as measured substantially from the center of the bit, of said center of gravity.

25. The system of claim 24, wherein said jet is projected to impact substantially between said cutting surface and said chip.

26. The system of claim 23, wherein said jet comprises a flow of hydraulic fluid defined by a nozzle mounted to said bit, said jet having a longitudinal axis terminating at an impact point, said impact point being in proximity to said point of engagement between said cutting surface and said formation.

27. The system of claim 23, wherein said jet is projected to a point between the radially innermost extent of said cutting surface and the lateral midpoint thereof.

28. A cutting system for use on a drill bit for cutting a plastic subterranean formation, comprising:

a substantially round bit body;

a cutter defining a lateral dimension and mounted on said bit body;

a nozzle associated only with said cutter and located nonsymmetrically on said bit body with respect to said lateral dimension of said cutter for directing a jet of fluid from said bit body to the general location at which said cutter extends farthest from said bit body and at an oblique angle to said lateral dimension.

29. The system of claim 28, wherein the center of said nozzle is disposed radially inwardly of the midpoint of said lateral dimension of said cutter.

30. The system of claim 29, wherein said location is further defined as extending from the radially innermost extent of said cutter and the lateral midpoint thereof.

31. A method for drilling a plastic subterranean formation, comprising:

providing a rotating drag bit having at least one cutter defining a lateral dimension mounted thereon;

cutting said formation with said at least one cutter by rotating said drag bit, whereby a chip of said formation is cut from said formation while still remaining partially attached thereto and substantially adhered to said cutter; and removing said chip from said cutter and detaching said chip from said formation by impacting said chip with a fluid jet proximate the point of attachment to said formation, said jet originating at a point radially inward from the lateral midpoint of said cutter.

32. The method of claim 31, wherein said fluid jet impacts said chip at an oblique angle to the instantaneous path of said cutter as said bit is rotated.

33. The method of claim 31, wherein said fluid jet impacts said chip substantially between said chip and said cutter.

* * * * *